United States Patent [19]

Gizienski et al.

[11] Patent Number: 4,867,693

[45] **Date of Patent: * Sep. 19, 1989**

[54] SAFETY ELECTRICAL TAP

[75] Inventors: John J. Gizienski, Coventry; Stephen P. Short, Johnston; Robert J. Mellen, North Kingstown, all of R.I.

[73] Assignee: General Electric Company, Schenectady, N.Y.

[ * ] Notice: The portion of the term of this patent subsequent to Sep. 19, 2006 has been disclaimed.

[21] Appl. No.: 226,505

[22] Filed: Aug. 1, 1988

[51] Int. Cl.[4] ..... H01R 13/44

[52] U.S. Cl. ..... 439/137

[58] Field of Search ..... 439/137–140

[56] References Cited

U.S. PATENT DOCUMENTS

| | | | |
|---|---|---|---|
| 2,545,536 | 10/1948 | von Holtz | 173/330 |
| 2,770,786 | 10/1952 | Czyzewski | 339/40 |
| 3,222,631 | 12/1963 | Cohen | 339/40 |
| 3,238,492 | 1/1964 | Houston | 339/40 |
| 3,986,763 | 10/1976 | Sparrow | 339/40 |
| 3,990,758 | 11/1976 | Petterson | 339/43 |
| 4,072,382 | 2/1978 | Reschke | 339/40 |
| 4,094,569 | 6/1978 | Dietz | 339/40 |
| 4,168,104 | 9/1979 | Buschow | 339/40 |
| 4,379,607 | 4/1983 | Bowden, Jr. | 339/40 |
| 4,544,219 | 10/1985 | Barkas | 339/40 |
| 4,722,693 | 2/1988 | Rose | 439/137 |
| 4,822,290 | 4/1989 | Cauley et al. | 439/137 |

FOREIGN PATENT DOCUMENTS

| | | | |
|---|---|---|---|
| 0243793 | 1/1961 | Australia | 439/137 |
| 751236 | 2/1953 | Fed. Rep. of Germany . | |
| 1440799 | 11/1962 | Fed. Rep. of Germany . | |
| 1465128 | 12/1964 | Fed. Rep. of Germany . | |
| 2434577 | 1/1976 | Fed. Rep. of Germany | 439/137 |
| 2434578 | 1/1976 | Fed. Rep. of Germany | 439/137 |
| 2038508 | 3/1978 | Fed. Rep. of Germany . | |
| 1311993 | 11/1962 | France . | |
| 1448863 | 6/1965 | France . | |
| 1425461 | 12/1965 | France . | |
| 210641 | 1/1967 | Sweden . | |
| 216519 | 10/1967 | Sweden . | |
| 314729 | 11/1967 | Sweden . | |
| 217538 | 12/1967 | Sweden . | |
| 230573 | 11/1942 | Switzerland . | |
| 239441 | 9/1943 | Switzerland . | |
| 1585094 | 2/1981 | United Kingdom . | |

*Primary Examiner*—P. Austin Bradley
*Attorney, Agent, or Firm*—Edward M. Corcoran; Stanley C. Corwin; Fred Jacob

[57] ABSTRACT

An electrical power tap is provided with at least one shutter mechanism to block spurious insertion of a foreign object through one blade slot short of the power circuit contacts of an adjacent pair of plug receptacles. This mechanism includes a pair slides supported for independent movement between closed-latched and open positions. Access to the contacts of either power tap plug receptacle requires that its slide first be unlatched by a blade penetrating one slot and then cammed to the open position by another blade penetrating the other slot, as occurs incident to the insertion of a standard electrical plug.

13 Claims, 7 Drawing Sheets

SAFETY ELECTRICAL TAP

The present invention relates to electrical wiring devices and particularly to electrical power taps which plug into existing electrical receptacles and which are of the safety or protective type such as to accept the insertion of a standard electrical plug, but inhibit the insertion of a foreign object into contact with electrically live parts thereof.

BACKGROUND OF THE INVENTION

It is well known that the multiplicity of electrical outlets or receptacles distributed about a dwelling represents a clear and present danger to curious children. Since a conventional receptacle provides clear, unobstructed paths from the slots in its face to the plug-in contacts therebehind for accepting the insertion of the blades of a standard electrical plug, the absence of the plug renders the contacts accessible to children inserting a thin, elongated object. If the object is metallic, such as a hairpin, paper clip, nail file, or the like, and is inserted into engagement with the live contacts of the receptacle, a serious, even fatal shock may be the tragic result.

There have been numerous approaches and designs proposed in an attempt to render electrical receptacles child-resistant. Perhaps the simplest approach is to insert the prongs of a plastic protective cap into the slots of all unused receptacles that are accessible to children. However, the reliability of this approach depends on the diligence of adults to ensure that protective caps are installed in all unused receptacles. Moreover, these protective caps are not particularly difficult to remove, even for children. An analogous and more reliable approach is to permanently mount to the face of the receptacle a protective cap having slots which are normally nonaligned with the receptacle slots. The cap is then manipulated to a position aligning its slots with the receptacle slots, whereupon the blades of a standard plug have access to the receptacle contacts.

Another basic approach has been to provide internal switches which can be actuated only by the concurrent insertions of a pair of plug blades to connect the receptacle contacts into the branch electrical circuit wired to the receptacle terminals. Thus, unless the switches are actuated, the receptacle contacts are dead and therefore safe to the touch by a conductive foreign object inserted into one of the receptacle slots.

Yet another basic approach is to provide shutters which are normally positioned to block access to the receptacle contacts for foreign objects inserted through either one of the receptacle slots, but are readily shifted to unblocking positions by the concurrent insertions of the blades of a standard electrical plug. The probability of a child simultaneously inserting foreign objects into both receptacle slots is so remote that this shuttered approach is considered reliably child-resistant. An example of this approach is disclosed in the commonly assigned, copending application entitle "Safety Electrical Receptacle". A disadvantage of this receptacle approach is that the conventional receptacle must be removed and the child-resistant receptacle installed in its place. Many do-it-yourself parents are reluctant to attempt projects of an electrical nature and thus elect to hire an electrician to perform this service. This poses an additional expense which may cause parents of small children to forego the safety advantage of such receptacles.

It is accordingly an object of the present invention to provide an improved safety electrical power tap which is simply plugged into an existing electrical receptacle.

Another object is to provide a safety electrical power tap of the above-character which is reliably child-resistant, yet is as convenient and facile to use for its intended purpose as a conventional power tap.

An additional object is to provide a safety electrical power tap of the above-character, which is inexpensive to manufacture in quantity, durable in construction, and reliable and virtually foolproof in operation over a long useful life.

Other objects of the invention will in part be obvious and in part appear hereinafter.

SUMMARY OF THE INVENTION

In accordance with the present invention, there is provided a safety electrical power tap in which is incorporated a shutter mechanism at a location intermediate the receptacle slots and the receptacle line and neutral plug-in contacts of each of its multiple plug receptacles. This shutter mechanism includes a stationary retainer serving to support a pair of adjacent plug receptacle slides for independent movement between a spring-biased, closed-latched position blocking access to the receptacle contacts and an open position granting access to these contacts through a series of intermediate access blocking closed-unlatched positions. Each slide includes a latch actuating nose and an underlying barrier ledge which are disposed in the plug blade insertion path through one plug receptacle slot to one of the tap plug-in contacts when the slide is in its closed-latched position. The slide further includes a slide actuating ramp disposed in blocking relation with the plug blade insertion path through the other plug receptacle slot to the other tap plug-in contacts.

To shift either slide to its open position unblocking the blade insertion paths, its nose must be depressed to unlatch the slide and shift it to closed-unlatched position. Only then can engagement of the ramp successfully cam the slide to its open position. These coordinated events naturally occur incident to the concurrent insertions of the blades of any conventional electrical plug, and thus complete access to the power tap contacts is granted to the blades. The sole insertion of a blade-like foreign object into engagement with the ramp can not cam the slide to its open position, since it remains in its closed-latched position. While the sole insertion of a foreign object into engagement with the nose unlatches the slide, it remains in a closed position with the underlying ledge blocking the insertion path to the power tap contacts therebehind. Thus, access to either of the tap contacts is denied to a blade-like foreign object inserted into either one of the tap slots, rendering the safety receptacle of the present invention reliably child-resistant.

The invention accordingly comprises the features of construction, arrangements of parts and combinations of elements, all of which will be exemplified in the construction hereinafter set forth, and the scope of the invention will be indicated in the claims.

For a better understanding of the nature and objects of the invention, reference may be had to the following detailed description taken in conjunction with the accompanying drawing, in which.

Corresponding reference numerals refer to like parts throughout the several views of the drawings.

DETAILED DESCRIPTION

Figure 1:
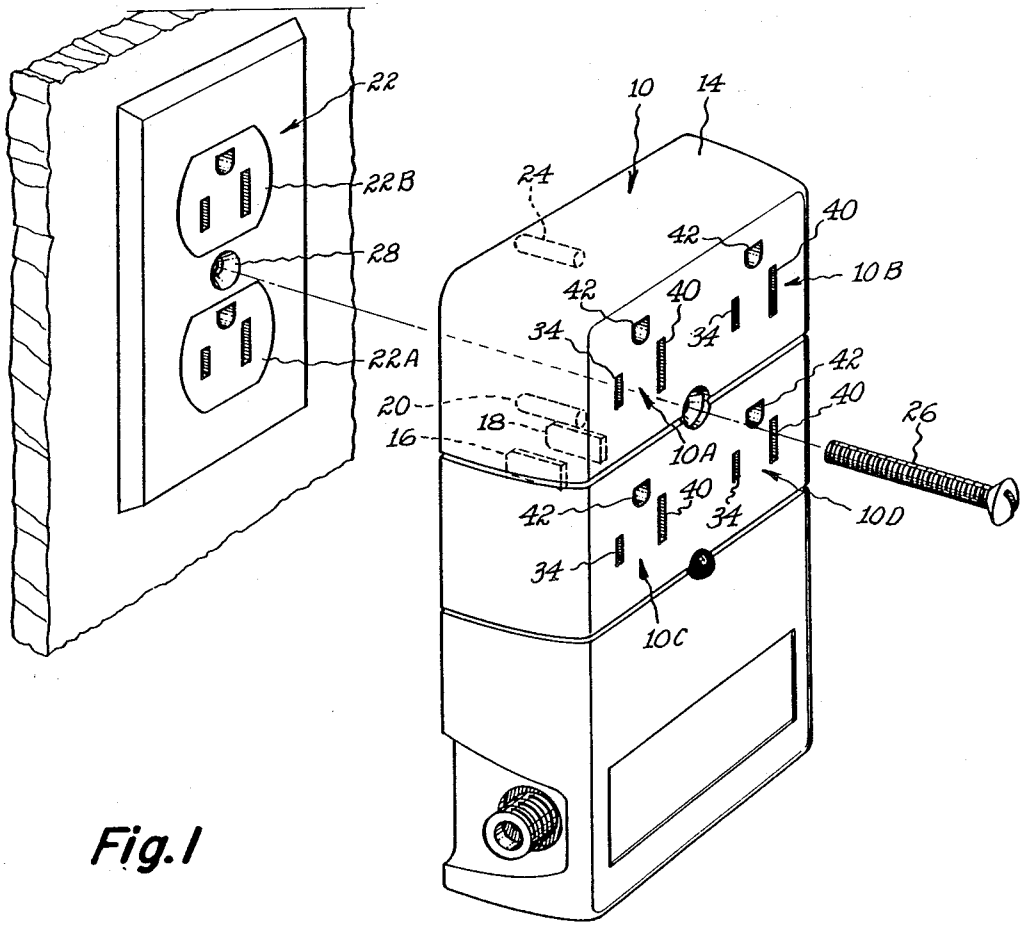
FIG. 1 is a perspective view, partially in phantom line, of a safety electrical power tap embodying the present invention.
Figure 2:
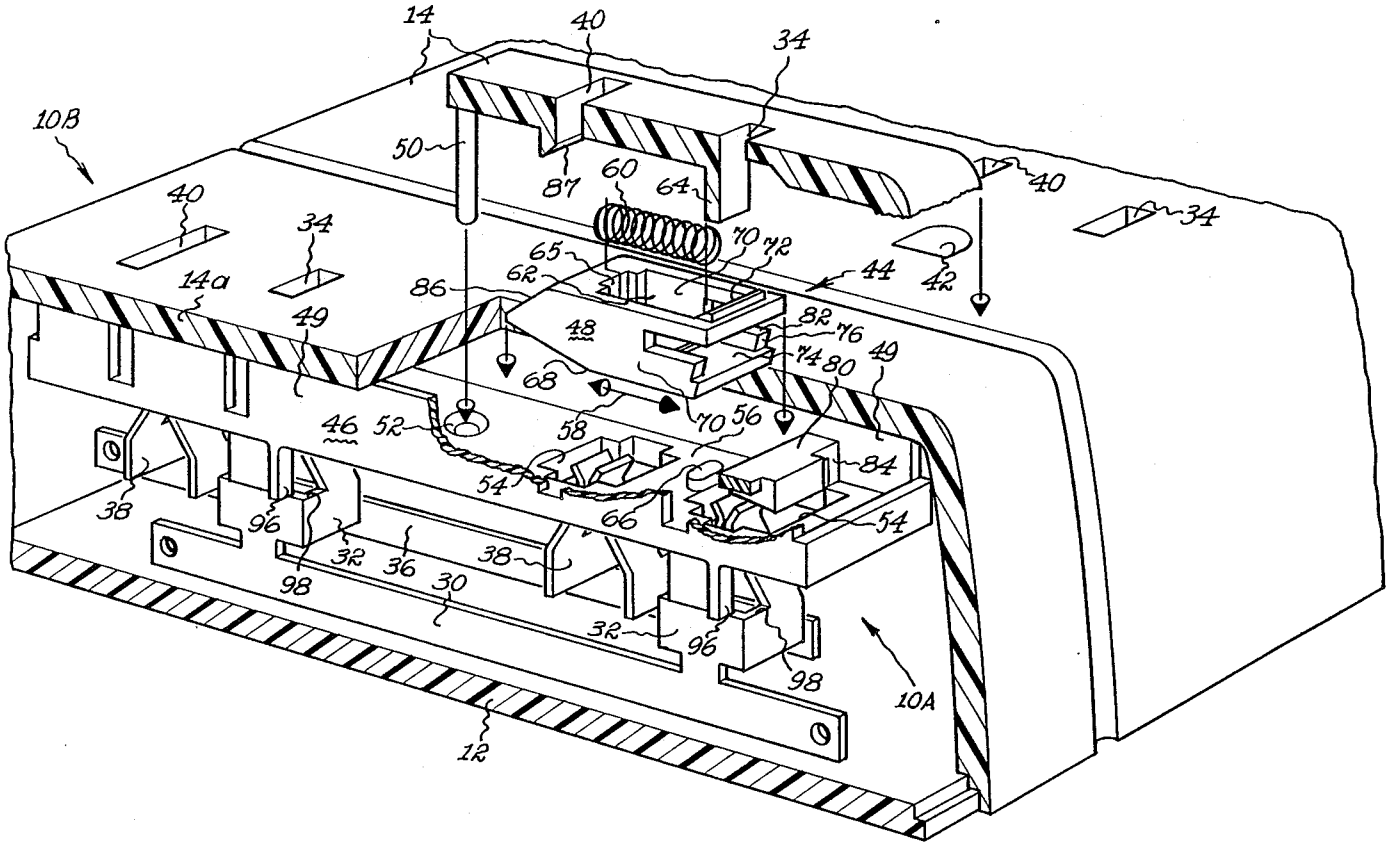
FIG. 2 is a perspective view, partially exploded and broken away, of the safety electrical power tap of FIG. 1.

The present invention is illustrated in FIGS. 1 and 2 in its embodiment as a safety electrical power tap, generally indicated at 10, having a four plug receptacles, generally indicated at 10A, 10B, 10C and 10D. The various electrical parts of the tap are positionally mounted by an insulative base 12 and enclosed by a molded plastic cover 14 secured thereto by suitable means, such as screws (not shown). As seen in FIG. 1, tap line and neutral blades, and a ground prong, respectively indicated in phantom at 16, 18 and 20, project rearwardly from base 12 for plug-in electrical engagement with a receptacle 22A of an existing duplex wall receptacle, generally indicated at 22. A second ground 24 may be provided for insertion in the other plug receptacle 22B. A screw 26 is threaded into the existing duplex receptacle cover-mounting screw hole 28 to secure the installation of power tap 10 to receptacle 22.

As seen in FIG. 2, a line busbar 30 is positionally mounted by suitable base surface formations, not shown, and is integrally formed with a pair of upstanding line plug-in contacts 32 respectively disposed in aligned, underlying relation with the line slots 34 in cover 14 for a horizontal pair of plug receptacles, e.g., plug receptacles 10C and 10D. Similarly, a neutral busbar 36 carries upstanding neutral plug-in contacts 38 in underlying alignment with the cover neutral slots 40 of the same horizontal pair of plug receptacles. While not shown, a ground busbar is equipped with ground plug-in contacts aligned beneath the cover ground slots 42 of the same horizontally adjacent pair of plug receptacles. The other horizontal pair of plug receptacles are provided with the same busbar and contact arrangement. Corresponding busbars are hard wired in parallel to the appropriated back projecting stab contacts 16, 18 and 20 (FIG. 1).

To render power tap 10 child-resistant in accordance with the present invention, a separate shutter mechanism, generally indicated at 44, is incorporated in cover 14 for each horizontal pair of plug receptacles. Each shutter mechanism includes, as seen in FIG. 2, an elongated retainer, generally indicated at 46, supporting a pair of slides, one generally indicated at 48. The retainer is retained to the underside of the cover front wall 14*a* during assembly by the frictional fit of a depending pin 50 in a retainer hole 52 and eventually clamped in place between the base and cover. Depending cover formations (not shown) ensure proper retainer orientation. The retainer is apertured, as indicated at 54, so as not to obstruct access to plug-in contacts 32 and 38 of each plug receptacle of the horizontal pair. Each slide 48 is supported immediately beneath cover front wall 14*a* by a separate platform surface 56 of retainer 46 and is guided by opposed internal cover formations (not shown) for reciprocating movement in the directions indicated by arrow 58 between extreme open and closed-latched positions and a range of intermediate closed (unlatched) positions. A separate spring 60, accommodated in the open inerior 62 of each slide, acts between a cover depending abutment 64 and a slide surface 65 to bias each slide to its close-latched position. An upstanding retainer lug 66 serves to maintain the one spring end properly positioned against this abutment in each instance.

Figure 3:
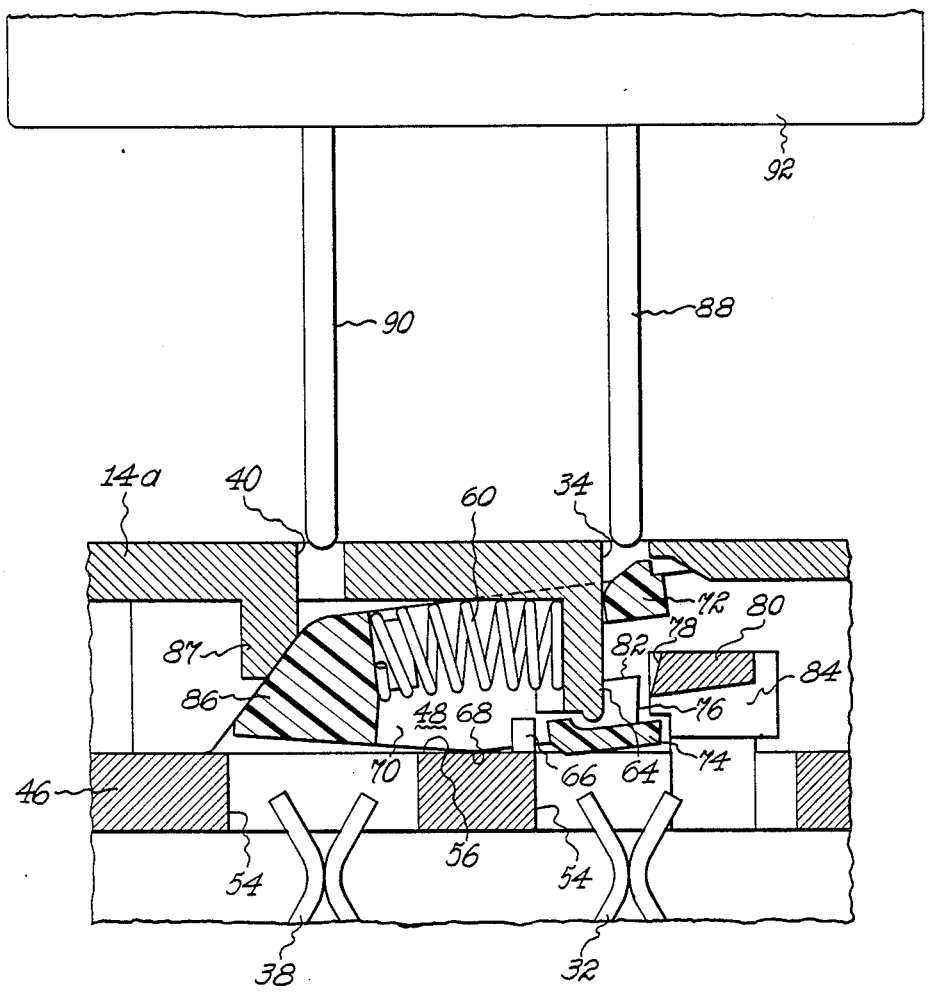
FIGS. 3 through 7 are a series of like sectional views illustrating the operation of the safety electrical power tap of FIG. 1.

Referring jointly to FIGS. 2 and 3, when each slide is in its closed position, its spring 60 rocks it in the counterclockwise direction (FIG. 3) about fulcrums 68 formed on the bottom edges of opposed arms 70 of the slide, which rest on retainer platform surface 56. This positions a transverse nose 72 carried by these arms in an obstructing position immediately behind receptacle slot 34. Underlying this nose, arms 70 carry a transverse barrier or ledge 74 disposed in the blade insertion path to line contacts 32, fully blocking access thereto. Each slide is formed to provide a pair of latches 76 which are poised, while slide 48 is in its counterclockwise rocked, closed-latched position, to engage a common catch 78 carried by retainer 46. Consequently, the slides are latched in their respective closed positions, i.e., closed and latched positions, to which they are biased by their springs 60. To unlatch a primary slide 48, its nose 72 must be depressed to rock the slide clockwise on its fulcrums 68 and thus disengage latches 76 from catch 78. The slide is thus shifted to a closed-unlatched position, free to slide rightward (FIG. 3) toward its open position on the bottom runner edges of arms 70, such motion being accommodated by the entry of an elevated transverse guide member 80 into notches 82 in the arms. This guide member, which is supported by upstanding retainer legs 84, provides with its supporting legs continuing guidance for the slide during movement from its closed-unlatched position to its open position. Latches 76 are provided by the end surface of arms, while catch 78 is provided by a surface of retainer member 80.

It is important to note that, while the insertion of a blade-like object through a slot 34 is effective to force nose 72 aside and shift the slide from its closed-latched position, such insertion is incapable of propelling the slide away from a closed position. Continued insertion is blunted short of plug-in contacts 32 by underlying ledge 74 which is oriented normal to the insertion path leading thereto. Consequently, the primary slide can not be forced aside to expose these contacts by the spurious penetration of an object into the receptacle via slot 34. Moreover, upon withdrawal of the object, spring 60 immediately restores the slide to its closed-latched position.

To block spurious access to plug-in contacts 38, each slide 48 is provided with a ramp 86 disposed immediately beneath a slot 40. The surface of this ramp is sloped such that the insert of an object through a slot 40 into engagement with the ramp exerts a force on the slide in a direction toward its open position. However, unless the slide has been unlatched and maintained so, it can not be moved away from its closed position by the insertion of a foreign object through slot 40. Thus, the slides 48 can be shifted from their closed-latched position defined by the abutment of their ramps 86 against respective depending cover stops 87, to their open position only in response to the insertions of blade-like objects into slots 34 and 40 concurrently, such as occur when a standard electrical plug is normally inserted into any one of the power tap plug receptacles.

Figure 4:
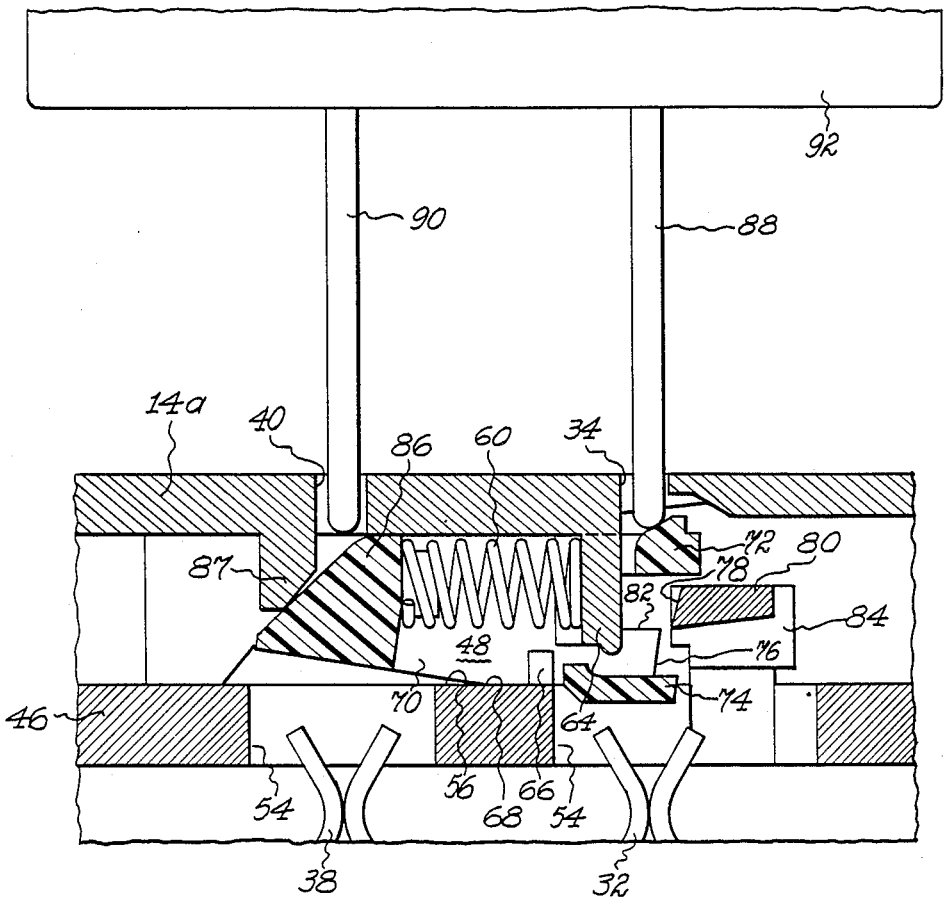
Figure 5:
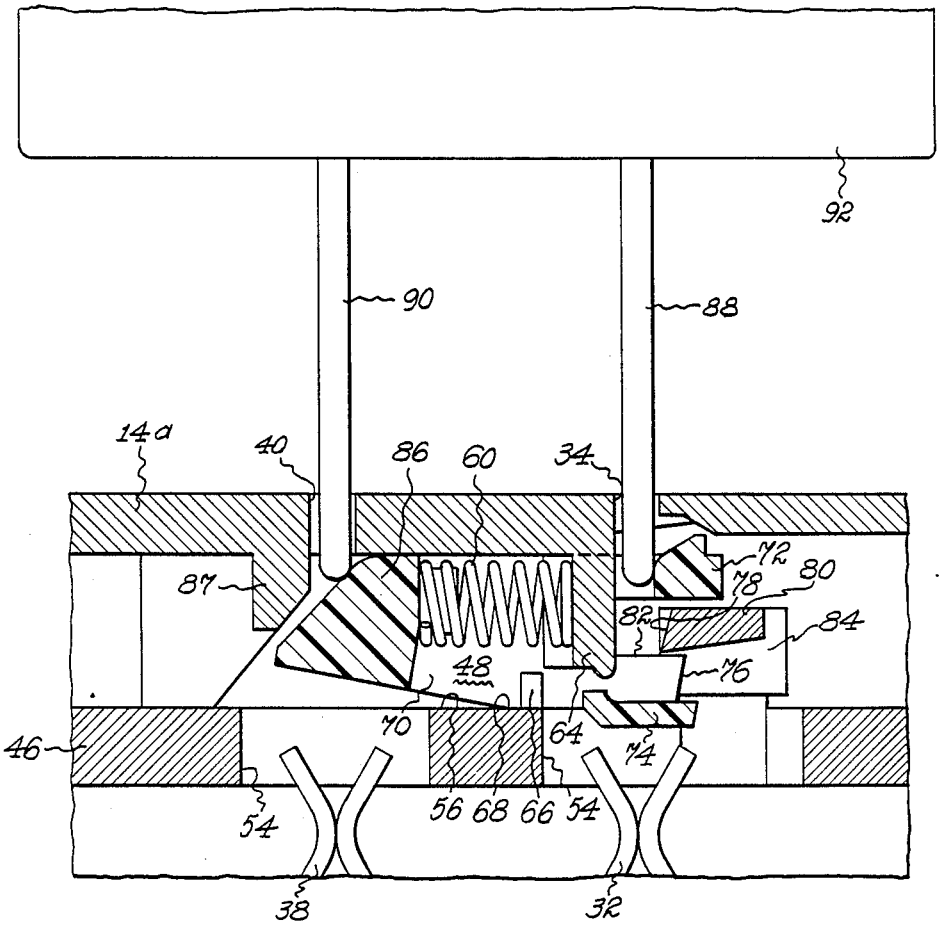
Figure 6:
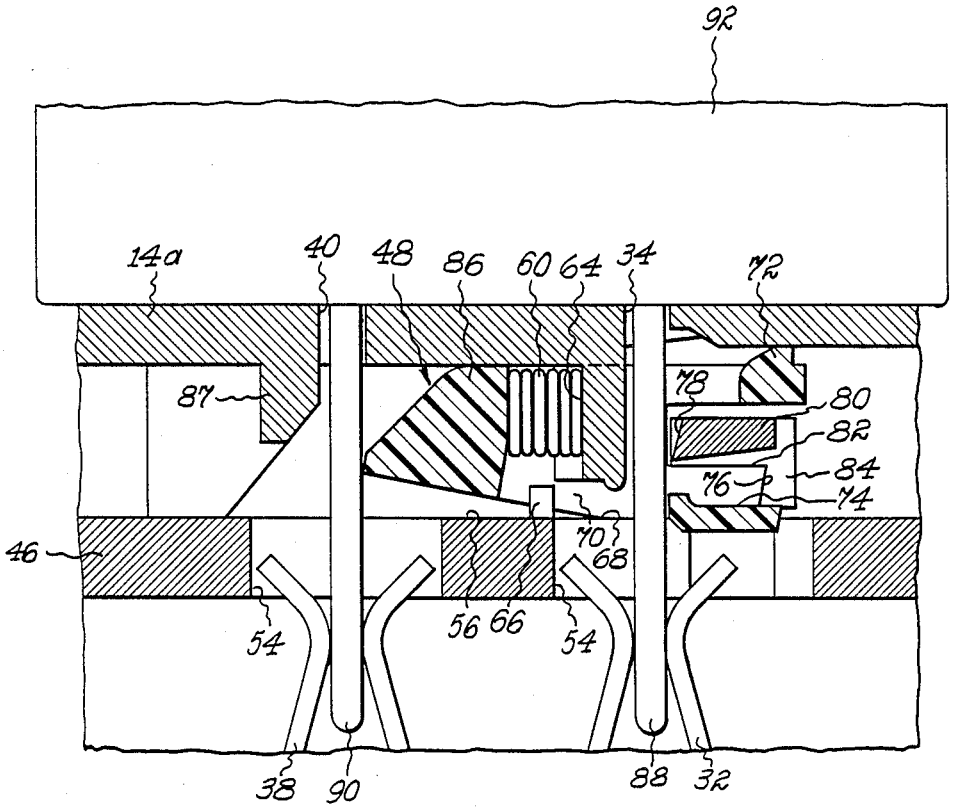

FIG. 4 illustrates this event. As blades the 88 and 90 of an electrical plug 92 are inserted, the former first engages nose 72 before the latter engages ramp 86. This is due to the fact that the nose is more elevated than the ramp by virtue of spring 60 having rocked its slide 48 on fulcrums 68 counterclockwise to the closed-latched position seen in FIG. 3. Thus, the initial engagement of blade 88 with nose 72 rocks slide 48 about its fulcrums in the clockwise direction to the closed (unlatched) position seen in FIG. 4. With continued insertion of the plug, blade 90 engages ramp 86, camming slide 48 rightwardly toward its open position, as illustrated in FIG. 5. Note that ledge 74 continues to block direct access to plug-in contacts 32, which are the live contacts assuming wall receptacle 32 (FIG. 1) is properly wired. Thus the slide is still in a closed-unlatched position. It is only until the slide is shifted completely to its open position by continued the penetration of blade 90 that ledge 74 fully uncovers contacts 32 to allow blade 88 to penetrate the slide interior opening 62 (FIG. 2) into plug-in engagement with these contacts, as illustrated in FIG. 6.

Figure 7:
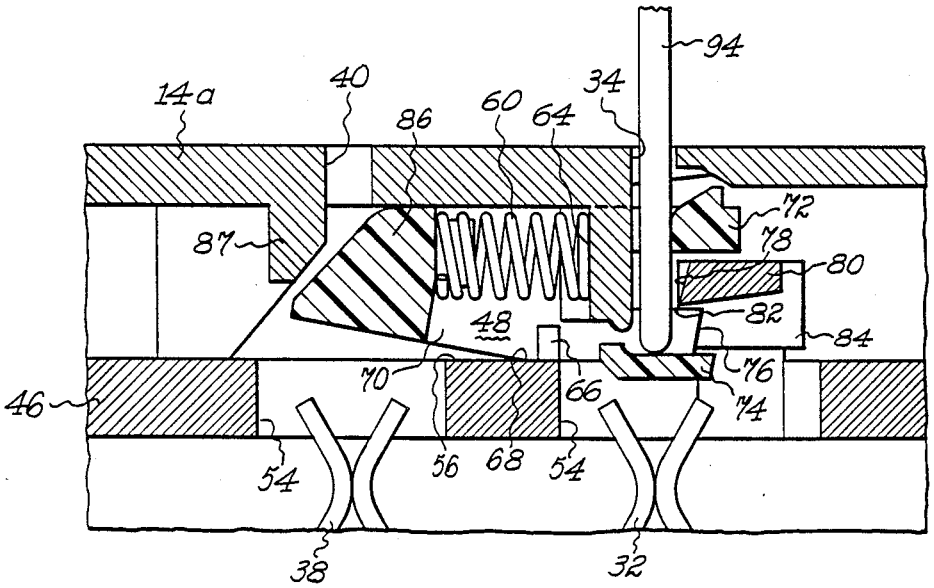

FIG. 7 illustrates the situation when a foreign object 94 is inserted through slot 34. Nose 72 is readily depressed to unlatch slide 48 and can be forced aside to permit further penetration as the slide is incrementally shifted rightward. However, the slide is still in a closed, albeit unlatched position, and ledge 74 remains in blocking relation with contacts 32 to prevent continued penetration of the foreign object into contact therewith. It will be appreciated from FIG. 3 that the spurious insertion of a foreign object through slot 40 is blocked by ramp 86 and, since the slide is in its closed-latched position, it cannot be cammed rightward to its open position. Thus, access to plug-in contacts 38 is denied, which contacts would be live if the wall receptacle is not wired in accordance with convention.

In addition to mounting a pair of slides 48, each retainer 46, which is formed of molded plastic, is integrally formed with a pair of depending tangs 96 (FIG. 2) which are positioned to bear on edges 98 of the pair of line plug-in contacts 32 when cover 14 is united with base 12. A corresponding pair of depending tangs (not shown) bear against the neutral contacts 38. These bearings tangs serve to prevent displacements of the line and neutral busbars and their integral plug-in contacts during plug blade withdrawal.

It is thus seen that the objects set forth above, including those made apparent from the preceding description, are efficiently attained, and since certain changes may be made in the above construction without departing from the scope of the invention, it is intended that all matters contained in the above description or shown in the accompanying drawings, shall be interpreted as illustrative and not in limiting sense.

Having fully described the invention, what is claimed as new and desired to secure by Letters Patent is:

1. A safety electrical power tap adapted for plug-in electrical engagement with an existing wall receptacle, said power tap comprising, in combination:

A. a base supporting at least two sets of separate first and second plug-in contacts of adjacent power tap plug receptacles;

B. a cover secured to said base and including a front wall having therein at least two sets of separate first and second slots of said adjacent plug receptacles, said first slots of each slot set being aligned with said first contacts of each contact set and said second slots of each slot set being aligned with said second contacts of each contact set, whereby to accommodate the insertions of a pair of blades of a standard electrical plug through said first and second slots of either slot set into respective electrical connections with the aligned set of said first and second contacts; and C. a shutter mechanism mounted intermediate said cover front wall and said sets of first and second contacts, said shutter mechanism including 1) a stationary retainer, 2) first and second stationary catches, 3) first and second slides supported by said retainer for independent movement between respective open, closed-latched and intermediate closed-unlatched positions, said first and second slides integrally formed including (a) respective first and second latches respectively engaging said first and second catches to independently latch said first and second slides in their closed-latched positions, (b) respective first and second latch actuating elements respectively disposed immediately beneath each said first slots in said slide closed-latched positions.

(c) respective first and second barriers respectively underlying said first and second latch actuating elements to obstruct the insertion paths between said first slots and said first contacts of said two sets in said closed-latched and slide closed-unlatched positions, and (d) respective first and second ramps obstructing the insertion paths between said second slots and said second contacts of said two sets in said slide closed-latched and said slide closed-unlatched positions, (3) respective first and second springs biasing said first and second slides toward said closed-latched positions (4) whereby, access to either set of said first and second contacts requires the concurrent insertions of a pair of blades of an electrical plug respectively through the aligned set of said first and second slots to initially shift the obstructing one of said first and second slides from said closed-latched position to said closed-unlatched position with said latch of said obstructing slide and the engageable one of said first and second catches in disengaged relation by depression of said latch actuating element of said obstructing slide in response to insertion of one blade, such as to then permit the engagement of the other blade with said ramp of said obstructing slide to cam said obstructing slide to said open position, thereby jointly removing said barrier and ramp of said obstructing slide from the respective blade insertion paths leading to either set of said first and second contacts.

2. The safety electrical power tap defined in claim 1, wherein said retainer further includes a platform surface, and each said first and second slide further includes a fulcrum resting on said platform surface, said first and second slides pivoting on said fulcrums between said closed-latched and closed-unlatched positions.

3. The safety electrical power tap defined in claim 2, wherein said retainer platform surface supports said first and second slides for independent sliding movements between said closed-unlatched and open positions.

4. The safety electrical power tap defined in claim 3, wherein said retainer further includes separate transverse guide members elevated from said platform surface, and each said slide being notched intermediate its said latch actuating element and barrier to accept said transverse guide member during slide movement between said closed-unlatched and open positions.

5. The safety electrical power tap defined in claim 4, wherein each said slide further includes a pair of transversely spaced arms joined at corresponding one ends with its said ramp and joined at corresponding other ends with its said latch actuating element and barrier.

6. The safety electrical power tap defined in claim 5, wherein said first and second stationary catches are formed on said retainer.

7. The safety electrical power tap defined in claim 6, wherein said first and second stationary catches are provided by surfaces of said transverse guide members, and said latches are provided by surfaces of said arms.

8. The safety electrical power tap defined in claim 3, wherein said retainer is secured to the underside of said cover front wall.

9. The safety electrical power tap defined in claim 8, wherein said cover further includes at least one pin depending from said underside of said cover front wall, said pin frictionally engaged in a hole in said retainer to retain said retainer in place during assembly.

10. The safety electrical power tap defined in claim 8, which further includes first and second busbars positionally mounted by said base, said first busbar integrally joined with said first plug-in contacts of said two contact sets to provide a first conductor unit, and said second busbar integrally joined with said second plug-in contacts of said two contact sets to provide a second conductor unit.

11. The safety electrical power tap defined in claim 10, wherein said retainer further includes depending tangs positioned to bear against said first and second conductor units when said cover is secured to said base, whereby to sustain the placement said first and second conductor units.

12. The safety electrical power tap defined in claim 11, wherein said cover further includes separate abutments depending from the under side of said cover front wall against which said first and second springs respectively act to bias said first and second slides to their said closed-latched positions.

13. The safety electrical power tap defined in claim 12, wherein said cover further includes separate stops depending from the underside of said front wall in respective positions engaging said first and second slides to define said closed-latched positions thereof.

* * * * *